United States Patent [19]

Milin

[11] Patent Number: 4,615,242

[45] Date of Patent: Oct. 7, 1986

[54] CAP COLLECTING OPENER

[75] Inventor: Ivan Milin, Scarborough, Canada

[73] Assignee: I. M. Engineering Ltd., Mississauga, Canada

[21] Appl. No.: 766,240

[22] Filed: Aug. 16, 1985

[51] Int. Cl.[4] ..... B67B 7/00

[52] U.S. Cl. ..... 81/3.08

[58] Field of Search ..... 81/3.08, 3.09, 3.15, 81/3.4

[56] References Cited

U.S. PATENT DOCUMENTS

| | | | |
|---|---|---|---|
| 2,090,714 | 8/1937 | Wright et al. | 81/3.08 |
| 2,116,306 | 5/1938 | Dziembowski | 81/3.08 |
| 2,588,687 | 3/1952 | Ajouelo | 81/3.08 |
| 2,728,250 | 12/1955 | Robert | 81/3.08 |
| 2,808,747 | 10/1957 | Cohen | 81/3.08 |
| 4,414,865 | 11/1983 | Brooks et al. | 81/3.09 |

*Primary Examiner*—James L. Jones, Jr.

*Attorney, Agent, or Firm*—Moss, Hammond

[57] ABSTRACT

A bottle opener for bottles having twist-off caps including a container having an end wall with an opening therein adapted for insertion of a bottle-mounted cap therein. A cylindrical member is connected to and extends into the container from the opening. The cylindrical member is open at the end thereof opposite the opening in the end wall and has a passageway adapted for passage of bottle caps through the cylindrical member and into the container. Longitudinal ridges on the interior of the cylindrical member hold an inserted bottle-mounted cap so that turning of the container about a longitudinal axis thereof extending perpendicular to the end wall causes the removal of the cap from its bottle. Preferably the opener includes means such as resilient fingers for preventing detached caps in the cylindrical member from falling out through the opening in the end wall.

19 Claims, 6 Drawing Figures

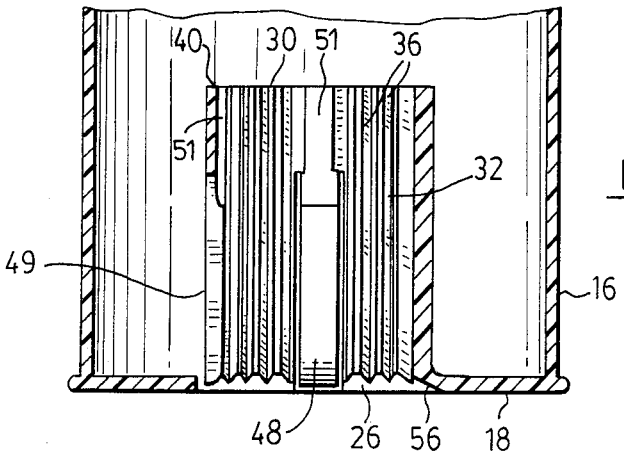
FIG. 2
FIG. 3
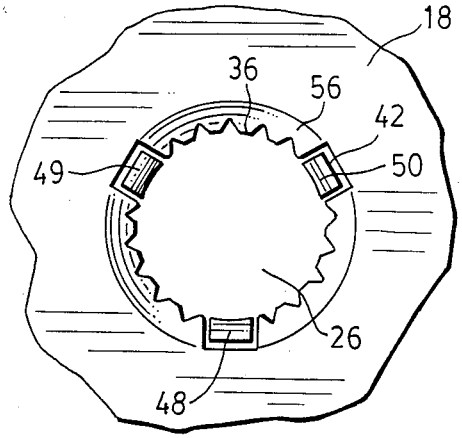
FIG. 4
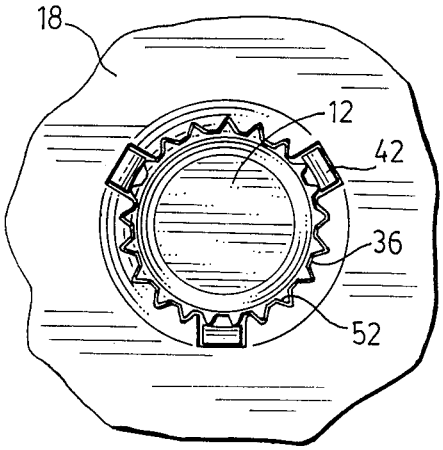
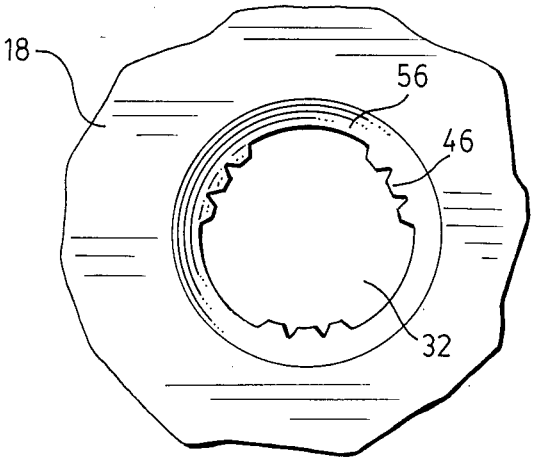
FIG. 5

CAP COLLECTING OPENER

BACKGROUND OF THE INVENTION

This invention relates to bottle openers and in particular openers suitable for removing twist-off caps. Although twist-off tops and caps have been known for quite some time in connection with various bottles and containers, up until recently they have not been used on glass bottles for such products as soft drinks and beer. Lately, however, with the development of new types of twist-off caps and bottle tops, caps that are intended to be removed by twisting have come into wide spread use. Some of these caps, particularly those designed for use on beer bottles, can be removed by either twisting or by prying them off with a standard bottle opener. A common difficulty with such caps, however, is that they can, at times, be difficult to remove with the use of only one's hand. Weaker persons and persons who must remove a large number of these twist-off caps often resort to the use of a cap removing tool of some sort.

A common problem with small metal bottle caps is that they are a nuisance to dispose of, particularly if one is rushed and is required to open a large number of bottles with these caps. Because the caps are small, made of metal, and can have sharp edges, they can also cause problems if left on the ground or on the floor. People in bare feet who accidently walk on such caps may be injured. Also a large number of caps littered on the ground can be quite unslightly.

Various device for removing twist-off caps are known in the opener art. These include simple metal grippers that can be used to clamp the sides of the cap prior to turning. These grippers may have serrated edges to permit the tool to grip the sides of the cap firmly. Ordinary pliers can also be used to remove twist-off caps if desired but pliers can be awkward to use for this purpose and may not be quick enough for the removal of a large number of bottle caps.

It is an object of the present invention to provide a bottle opener for bottles having twist-off caps, which opener comes with a container into which the caps pass after they have been removed from their bottles.

It is a further object of the present invention to provide a bottle opener for bottles having twist-off caps that can be constructed in an inexpensive manner using plastics material and that is easy to use.

SUMMARY OF THE INVENTION

According to one aspect of the invention, a bottle opener for bottles having twist-off caps includes a container having an end wall with an opening therein adapted for insertion of a bottle-mounted cap therein. A cylindrical member is connected to and extends into the container from the opening. The cylindrical member is open at the end thereof opposite the opening in said end wall and has a passageway adapted for passage of bottle caps through the cylindrical member and into the container. There are means on the interior of the cylindrical member for holding an inserted bottle-mounted cap so that turning of the container about a longitudical axis thereof extending perpendicular to the end wall causes the removal of the cap from its bottle.

According to a further aspect of the invention, a bottle opener for bottles having twist-off caps includes a container having an opening at one end thereof adapted for insertion of a bottle-mounted cap therein and a cylindrical member at the one end of the container. The opening is located at one end of the cylindrical member which is open at the end thereof opposite the container opening. The cylindrical member has a longitudinal passageway adapted for passage of bottle caps through said cylindrical member and into said container. Teeth means on the interior of the cylindrical member hold an inserted bottle-mounted cap so the turning of the container about a longitudinal axis thereof extending perpendicular to the end wall causes the removal of the cap from its bottle.

Preferably means are provided for preventing removed bottle caps in the cylindrical member from falling out through the opening in the end of the container.

Further details and advantages will become apparent from the following detailed description when considered in conjunction with the accompanying drawings.

BRIEF DESCRIPTION OF THE DRAWINGS

FIG. 2 is a sectional view taken along the line II—II of FIG. 1;

FIG. 3 is an end view showing the cap receiving opening in the bottom of the opener;

FIG. 4 is an end view similar to FIG. 3 but showing a twist-off cap held in the opening;

FIG. 5 is a view similar to FIG. 3 but showing an alternative embodiment having fewer longitudinally-extending teeth; and, FIG. 6 is a perspective view of an alternative form of removable top for the opener.

DETAILED DESCRIPTION OF PREFERRED EMBODIMENTS

Figures 1, 6:
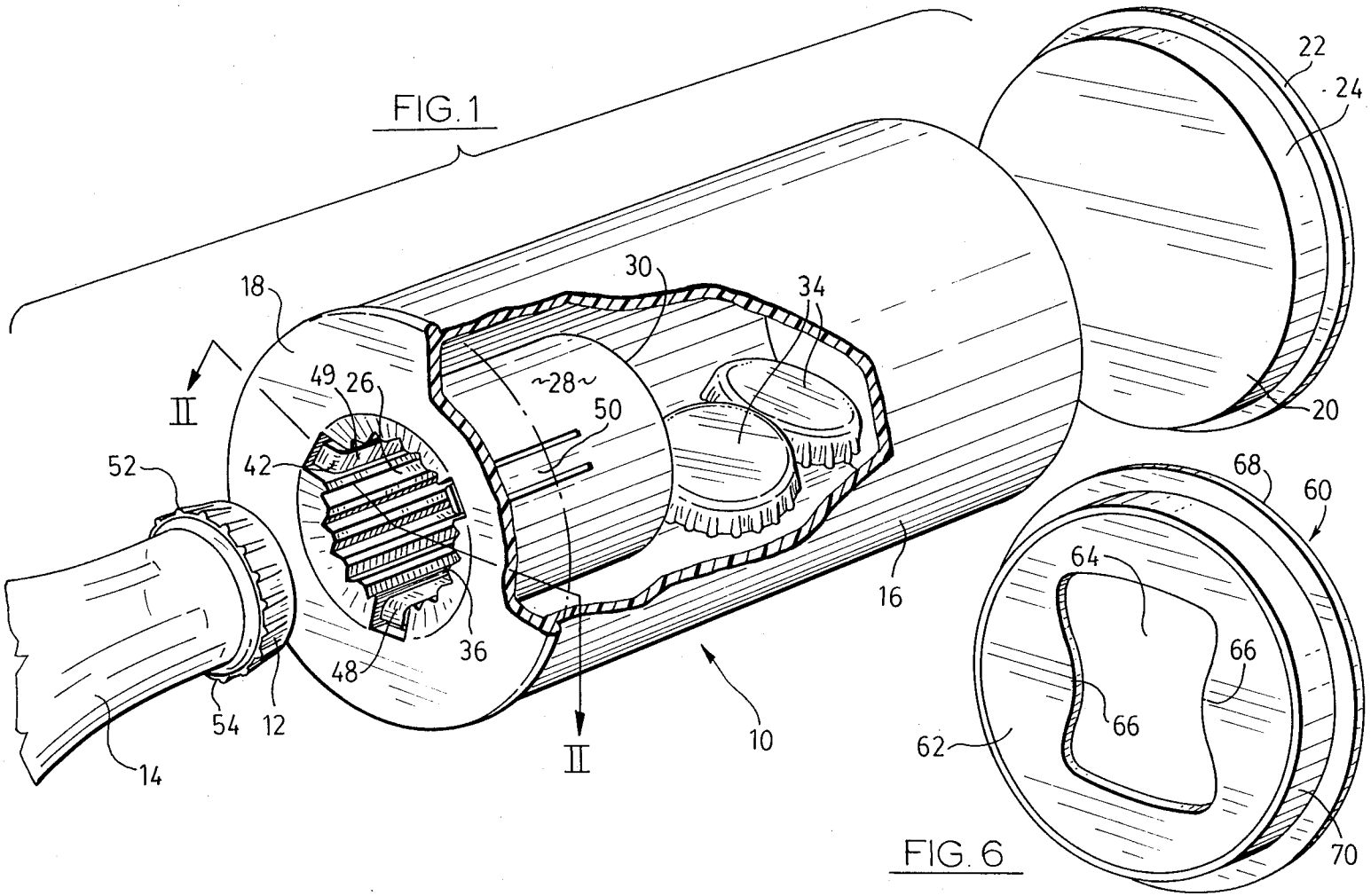
FIG. 1 is a perspective view, partially broken away, showing a bottle opener constructed in accordance with the invention.

A bottle opener 10 constructed in accordance with the invention is capable of removing a twist-off cap 12 from a bottle 14, only the top of which is shown in FIG. 1. The bottle and cap are of standard construction and can be of the type now used for beer bottles. The opener includes a cylindrical container 16 having an end wall 18 and a removable, circular top 20. The top, which can be made of the same material as the main portion of the container, has a rim 22 with an outer diameter equal to or slightly greater than the diameter of the container 16. A main section 24 of the top has a diameter substantially equal to the inside diameter of the container. The top can be held in place on the container simply by a friction fit between the section 24 and the inner surface of the container.

In the end wall 18 is an opening 26 adapted for insertion of a bottle-mounted cap 12. Preferably the opening 26 is located in the centre of the end wall and is just large enough to permit the cap to be inserted. The opening 26 is located at one end of a cylindrical member 28 connected to the end wall. The member 28 extends into the container from the opening and is open at the end 30 opposite the opening 26. As can be seen from FIGS. 1 and 2, the cylindrical member 28 has a passageway 32 of uniform diameter extending longitudinally the entire length of the cylindrical member. This passageway permits bottle caps to pass through the cylindrical member and into the container 16. Some removed caps 34 can be seen in the container in FIG. 1. It will be appreciated that the container 16 shown in FIG. 1 can contain a large number of bottle caps of the size shown. These caps can be removed at any time for disposal in a garbage container by removing the top 20.

It will be seen from an examination of FIGS. 1 to 4 that there are means on the interior of the cylindrical member 28 for holding an inserted bottle-mounted cap 12 so that turning of the container 16 about a longitudinal axis thereof extending perpendicular to the end wall 18 causes removal of the cap from its bottle 14. Preferably the holding means comprise teeth in the form of longitudinally extending ridges 36 running from one end of the cylindrical member to the opposite end. In the preferred embodiment of FIGS. 1 to 4, there are twenty-one teeth or ridges 36 but only eighteen of these extend all the way to the opening 26 as can be seen from FIGS. 1 and 3. Three of the teeth, including a tooth 40 shown in FIG. 2, extend only part way down the cylindrical member from the end 30. These three teeth are replaced by finger means 42, the ends of which can be seen in FIGS. 3 and 4. It will be appreciated by those skilled in the art that the number of teeth or ridges 36 can be varied from the number shown. In the embodiment shown in FIG. 5, there are only three sets of three ridges 46 in the cylindrical member. Preferably the three sets are distributed evenly about the circumference of the cylindrical member. As few as two longitudinally extending ridges could be used in the cylindrical member for holding the cap against turning relative to the cylindrical member.

Turning now to the construction of the aforementioned finger means, the means 42 help to prevent removed bottle caps in the cylindrical member 28 from falling out through the opening 26 after the cap has been detached. The preferred finger means shown comprise three finger members 48, 49, and 50, each of which extends longitudinally along the interior surface of the cylindrical member 28. As shown in FIG. 3, the outer surface of the fingers is in approximate alignment with the tops of the teeth or ridges 36. Because of the outerwardly projecting ribs 52 on the bottle cap, the insertion of the bottle cap into the passageway 32 causes the fingers to be pushed outwardly as shown in FIG. 4. When the cap has been detached by turning the container 16, it will still be engaged by the fingers which will press inwardly on the ribs 52. The engagement of the fingers thus prevents the cap from falling out of the opening 26 when the end of the bottle is removed from the opener. It will be appreciated by those skilled in the art that the number of fingers can vary. In fact, there can be one, two, or four fingers instead of the three shown.

In a preferred embodiment, the upper end of each finger and the region of the cylindrical member 28 above each finger is recessed at 51. This permits the caps to move easily through the upper section of the member 28 without interference from the upper end of each finger which has very limited flexibility.

The use of finger means, although preferred, is not essential to provide means for preventing caps from falling out through the opening 26. In fact, such prevention means can be provided by the interior surface of the cylindrical member 28. This interior surface can be dimensioned to snuggly engage the perimeter of the caps. As a result of this snug engagement, caps will not normally fall out of the opening 26. It will be appreciated that the caps normally have a relatively sharp bottom edge 54 and this edge tends to dig into the plastics material from which the opener can be formed. In fact, the preferred material for the entire bottle opener 10 is a plastics material, and in particular high impact polystyrene. The opener can be made by the well known injection molding process and thus it is inexpensive to make.

In order to permit the easy insertion of the bottle cap through the opening 26, the edge of the opening is preferably bevelled at 56. Thus the cap 12 is guided by the bevelled surface into the opening.

The length of the cylindrical member 28 can vary from that shown in the drawings. Its length will depend to some extent on the length of the bottle neck on the bottle to be opened. The cylindrical member should be sufficiently long that there is no possiblity of pushing the cap 12 all of the way through the cylindrical member 28 prior to removal of the cap from the bottle.

An alternative form of top for the container 16 is shown in FIG. 6. This top 60 has additional means for removing bottle caps, such as caps that can be removed by a prying action. In the illustrated embodiment, the bottom plate 62 of the hollow cap 60 has an opening 64 cut therein. The opening 64 is large enough to permit the partial insertion of a standard bottle cap. By placing the inward extension 66 under the bottom edge of the bottle cap, the cap can be removed in a well known manner. An opener 10 fitted with the top 60 can thus be used to open either a twist-off cap or a pry-off cap. At least the bottom plate 62 of the cap 60 is made of metal plate of sufficient strength to enable the cap to be used as an opener. Although the entire cap 60 can be made from metal if desired, the top 68 can be made from rigid plastic if desired, as well as the cylindrical side 70.

The exterior of the container 16 can be decorated or covered if desired. For example, a suitable paper label can be adhered to the exterior of the container. Alternatively, a pattern, design or writing can be printed on the plastics material forming the container.

It will be appreciated by those skilled in this art that various modifications and changes can be made to the bottle opener described herein without departing from the spirit and scope of this invention. Accordingly, all such modifications and changes as fall within the scope of the appended claims are intended to form part of this invention.

We therefore claim:

1. A bottle opener for bottles having twist-off caps comprising:

a container having an end wall with an opening therein adapted for insertion of a bottle-mounted cap therein;

a cylindrical member connected to and extending into said container from said opening, said cylindrical member being open at the end thereof opposite said opening in said end wall and having a passageway adapted for passage of bottle caps through said cylindrical member and into said container; and, means on the interior of said cylindrical member for holding an inserted bottle-mounted cap so that turning of said container about a longitudinal axis thereof extending perpendicular to said end wall causes the removal of said cap from its bottle.

2. A bottle opener according to claim 1 including means for preventing removed bottle caps in said cylindrical member from falling out through said opening in said end wall.

3. A bottle opener according to claim 2 wherein said prevention means comprise resilient finger means extending longitudinally along the interior surface of said cylindrical member.

4. A bottle opener according to claim 2 wherein said prevention means is provided by the interior surface of said cylindrical member which is dimensioned to snuggly engage the perimeter of said caps.

5. A bottle opener according to claim 1, wherein said container includes a removable top.

6. A bottle opener according to claim 1, wherein the bottle opener is made from a plastics material.

7. A bottle opener according to claim 1, wherein the bottle opener is made from high impact polystyrene.

8. A bottle opener according to claim 1, wherein said container includes a removable top having additonal means for removing bottle caps.

9. A bottle opener according to claim 1, wherein the edge around said opening in said end wall is bevelled to permit easy insertion of a twist-off cap.

10. A bottle opener for bottles having twist-off caps comprising:

a container having an opening at one end thereof adapted for insertion of a bottle-mounted cap therein;

a cylindrical member at said one end of said container, said opening being located at one end of said member, said cylindrical member being open at the end thereof opposite said container opening and having a longitudinal passageway adapted for passage of bottle caps through said cylindrical member and into said container; and, teeth means on the interior of said cylindrical member for holding an inserted bottle-mounted cap so that turning of said container about a longitudinal axis thereof extending perpendicular to said end wall causes the removal of said cap from its bottle.

11. A bottle opener according to claim 10 including means for preventing removed bottle caps in said cylindrical member from falling out through said opening in the end of the container.

12. A bottle opener according to claim 11 wherein said prevention means comprise resilient finger means extending longitudinally along the interior surface of said cylindrical member.

13. A bottle opener according to claim 11, wherein said teeth means are formed by longitudinally extending ridges running from one end of said cylindrical member to the opposite end.

14. A bottle opener according to claim 12 wherein said teeth means are formed by three sets of longitudinally extending ridges running from one end of said cylindrical member to the opposite end and said finger means include three finger members, each set of ridges being located between a respective two of said finger members.

15. A bottle opener according to claim 10, wherein the edge around said opening in said container is bevelled to permit easy insertion of a twist-off cap.

16. A bottle opener according to claim 11, wherein said container includes a removable top.

17. A bottle opener according to claim 11, wherein said container includes a removable top having additional means for removing bottle caps.

18. A bottle opener according to claim 11, wherein the bottle opener is made from a strong, rigid, plastics material.

19. A bottle opener acording to claim 11, wherein the bottle opener is made from high impact polystyrene.

* * * * *